US007717184B2

(12) United States Patent
Vold et al.

(10) Patent No.: US 7,717,184 B2
(45) Date of Patent: May 18, 2010

(54) SAFETY INTERLOCK FOR CONTROL LINES

(75) Inventors: Gisle Vold, Sandnes (NO); Egil Abrahamsen, Katy, TX (US); Svein Egil Vestersjo, Hundvaag (NO); Terje Baustad, Stavanger (NO); Kaj Stokkeland, Sirevag (NO); David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 79 days.

(21) Appl. No.: 11/565,461

(22) Filed: Nov. 30, 2006

(65) Prior Publication Data

US 2007/0137868 A1 Jun. 21, 2007

Related U.S. Application Data

(63) Continuation-in-part of application No. 11/037,800, filed on Jan. 18, 2005, now Pat. No. 7,249,637.

(60) Provisional application No. 60/740,849, filed on Nov. 30, 2005, provisional application No. 60/536,800, filed on Jan. 15, 2004.

(51) Int. Cl.
*E21B 19/12* (2006.01)

(52) U.S. Cl. ..... 166/385; 166/77.1; 166/85.5; 166/241.5; 175/57

(58) Field of Classification Search ..... None
See application file for complete search history.

(56) References Cited

U.S. PATENT DOCUMENTS

| | | | |
|---|---|---|---|
| 1,541,669 | A | 6/1925 | Summers |
| 2,063,361 | A | 12/1936 | Baash |
| 2,298,507 | A | 10/1942 | Penick et al. |
| 2,589,159 | A | 3/1952 | Stone |
| 2,934,148 | A | 4/1960 | Allaire |
| 3,063,509 | A | 11/1962 | Guier |
| 3,099,323 | A | 7/1963 | Kelley |
| 3,188,708 | A | 6/1965 | O'Haver |
| 3,287,776 | A | 11/1966 | Brown |
| 3,330,354 | A | 7/1967 | Chamblee |

(Continued)

FOREIGN PATENT DOCUMENTS

| | | |
|---|---|---|
| CA | 2 284 428 | 4/2001 |

(Continued)

OTHER PUBLICATIONS

Dual Elevator on KTB Rig, Bohranlage, Bohrplatz und Bohrlochsicherungssystem, p. 449-450.

*Primary Examiner*—Zakiya W. Bates
(74) *Attorney, Agent, or Firm*—Patterson & Sheridan, LLP

(57) ABSTRACT

A protection tool is provided to protect a control line in a safe area while one or more slips of a spider are being closed. In another embodiment, a safety interlock system is provided to prevent the closing of the slips before the control line is pulled away from the tubular string. In yet another embodiment, a safety interlock system includes a safety interlock trigger adapted to be actuated by a protection tool. The safety interlock trigger is adapted to detect the physical presence of the protection tool, and thereafter send a signal to the interlock system to enable an operator or a control mechanism to safely close the slips.

39 Claims, 6 Drawing Sheets

U.S. PATENT DOCUMENTS

| | | | | |
|---|---|---|---|---|
| 3,675,278 | A | 7/1972 | Powell | |
| 3,748,702 | A | 7/1973 | Brown | |
| 4,035,012 | A | 7/1977 | Guier | |
| 4,126,348 | A | 11/1978 | Palmer | |
| RE29,995 | E | 5/1979 | Guier | |
| 4,208,158 | A | 6/1980 | Davies et al. | |
| 4,209,066 | A | 6/1980 | Watson | |
| 4,317,491 | A * | 3/1982 | Tullos et al. | 175/57 |
| 4,326,745 | A | 4/1982 | Guier | |
| 4,354,706 | A | 10/1982 | Coyle, Sr. | |
| 4,381,584 | A | 5/1983 | Coyle, Sr. | |
| 4,396,216 | A | 8/1983 | Hamilton | |
| 4,417,846 | A | 11/1983 | Elliston | |
| 4,421,447 | A | 12/1983 | Gudgel et al. | |
| 4,489,794 | A | 12/1984 | Boyadjieff | |
| 4,523,645 | A | 6/1985 | Moore | |
| 4,600,054 | A | 7/1986 | Miller et al. | |
| 4,643,259 | A | 2/1987 | Zeringue, Jr. | |
| 4,715,456 | A | 12/1987 | Poe, Jr. et al. | |
| 4,800,968 | A | 1/1989 | Shaw et al. | |
| 4,843,945 | A | 7/1989 | Dinsdale | |
| 4,867,236 | A | 9/1989 | Haney et al. | |
| 5,042,601 | A | 8/1991 | Penisson | |
| 5,083,356 | A | 1/1992 | Gonzalez et al. | |
| 5,335,756 | A | 8/1994 | Penisson | |
| 5,484,040 | A | 1/1996 | Penisson | |
| 5,609,226 | A | 3/1997 | Penisson | |
| 5,848,647 | A | 12/1998 | Webre et al. | |
| 6,056,060 | A | 5/2000 | Abrahamsen et al. | |
| 6,089,338 | A | 7/2000 | Bouligny, Jr. | |
| 6,131,664 | A | 10/2000 | Sonnier | |
| 6,192,981 | B1 | 2/2001 | Boquet et al. | |
| 6,237,684 | B1 | 5/2001 | Bouligny, Jr. et al. | |
| 6,378,399 | B1 | 4/2002 | Bangert | |
| 6,422,311 | B1 | 7/2002 | Jansch | |
| 6,591,471 | B1 | 7/2003 | Hollingsworth et al. | |
| 6,742,596 | B2 | 6/2004 | Haugen | |
| 6,920,931 | B1 | 7/2005 | Webre et al. | |
| 7,044,216 | B2 | 5/2006 | Otten et al. | |
| 7,124,828 | B2 | 10/2006 | Jansch | |
| 7,216,716 | B2 | 5/2007 | Cole et al. | |
| 7,222,677 | B2 | 5/2007 | Webre et al. | |
| 2002/0096337 | A1 | 7/2002 | Bouligny et al. | |
| 2003/0066718 | A1 | 4/2003 | Buck | |
| 2003/0173117 | A1 | 9/2003 | Mason et al. | |
| 2004/0035587 | A1 | 2/2004 | Hollingsworth et al. | |
| 2004/0069500 | A1 | 4/2004 | Haugen | |
| 2005/0000696 | A1 | 1/2005 | McDaniel et al. | |
| 2005/0161225 | A1 | 7/2005 | Cole et al. | |
| 2005/0161227 | A1 | 7/2005 | Hayes et al. | |
| 2005/0161230 | A1 | 7/2005 | Webre et al. | |
| 2005/0183862 | A1 * | 8/2005 | Buytaert et al. | 166/379 |
| 2005/0230110 | A1 * | 10/2005 | Ellison et al. | 166/255.1 |

FOREIGN PATENT DOCUMENTS

| | | |
|---|---|---|
| DE | 19814033 | 10/1999 |
| EP | 0 479 583 | 4/1992 |
| FR | 2 658 972 | 8/1991 |
| GB | 2 014 215 | 8/1979 |
| GB | 2 355 030 | 4/2001 |
| WO | WO 99/10674 | 3/1999 |
| WO | WO 01/69034 | 9/2001 |

* cited by examiner

SAFETY INTERLOCK FOR CONTROL LINES

CROSS-REFERENCE TO RELATED APPLICATIONS

This application claims benefit of co-pending U.S. Provisional Patent Application Ser. No. 60/740,849, filed on Nov. 30, 2005. This application is also a continuation-in-part of U.S. patent application Ser. No. 11/037,800, filed Jan. 18, 2005 now U.S. Pat. No. 7,249,637, which claims benefit of U.S. Provisional Patent Application Ser. No. 60/536,800, filed Jan. 15, 2004. Each of the aforementioned related patent applications is herein incorporated by reference in its entirety.

BACKGROUND OF THE INVENTION

1. Field of the Invention

Embodiments of the present invention relate to the makeup of tubular strings at the surface of a well. More particularly, the invention relates to making up strings and running the strings into the well along with a control line or signal transmission line. More particularly still, the invention relates to methods and apparatus for facilitating the clamping of a control line or signal transmission line to a tubular string prior to lowering the string, clamp, and such line into the well.

Embodiments of the present invention also relate to methods and apparatus for preventing damage to the control line while running tubulars.

2. Description of the Related Art

Strings of pipe are typically run into a wellbore at various times during the formation and completion of a well. A wellbore is formed for example, by running a bit on the end of the tubular string of drill pipe. Later, larger diameter pipe is run into the wellbore and cemented therein to line the well and isolate certain parts of the wellbore from other parts. Smaller diameter tubular strings are then run through the lined wellbore either to form a new length of wellbore therebelow, to carry tools in the well, or to serve as a conduit for hydrocarbons gathered from the well during production.

As stated above, tools and other devices are routinely run into the wellbore on tubular strings for remote operation or communication. Some of these are operated mechanically by causing one part to move relative to another. Others are operated using natural forces like differentials between downhole pressure and atmospheric pressure. Others are operated hydraulically by adding pressure to a column of fluid in the tubular above the tool. Still others need a control line to provide either a signal, power, or both in order to operate the device or to serve as a conduit for communications between the device and the surface of the well. Control lines (also known as umbilical cords) can provide electrical, hydraulic, or fiber optic means of signal transmission, control and power.

Because the interior of a tubular string must be kept clear for fluids and other devices, control lines are often run into the well along an outer surface of the tubular string. For example, a tubular string may be formed at the surface of a well and, as it is inserted into the wellbore, a control line may be inserted into the wellbore adjacent the tubular string. The control line is typically provided from a reel or spool somewhere near the surface of the well and extends along the string to some component disposed in the string. Because of the harsh conditions and non-uniform surfaces in the wellbore, control lines are typically fixed to a tubular string along their length to keep the line and the tubular string together and prevent the control line from being damaged or pulled away from the tubular string during its trip into the well.

Control lines are typically attached to the tubular strings using clamps placed at predetermined intervals along the tubular string by an operator. Because various pieces of equipment at and above well center are necessary to build a tubular string and the control line is being fed from a remotely located reel, getting the control line close enough to the tubular string to successfully clamp it prior to entering the wellbore is a challenge. In one prior art solution, a separate device with an extendable member is used to urge the control line towards the tubular string as it comes off the reel. Such a device is typically fixed to the derrick structure at the approximate height of intended engagement with a tubular traversing the well center, the device being fixed at a significant distance from the well center. The device is telescopically moved toward and away from well center when operative and inoperative respectively. The device must necessarily span a fair distance as it telescopes from its out of the way mounting location to well center. Because of that the control line-engaging portion of the device is difficult to locate precisely at well center. The result is often a misalignment between the continuous control line and the tubular string making it necessary for an operator to manhandle the control line to a position adjacent the tubular before it can be clamped.

Another challenge to managing the control lines is the accidental closing of the slips around the control lines. Typically, while the control line is being clamped to the tubular string, the slips are open to allow the string and the newly clamped control line to be lowered into the wellbore. When the control line is near the tubular string, it is exposed to potential damage by the slips. Thus, if the slips are prematurely closed, the slips will cause damage to the control line.

There is a need therefore for an apparatus which facilitates the clamping of control line to a tubular string at the surface of a well. There is additionally a need for an apparatus which will help ensure that a control line is parallel to the center line of a tubular string as the control line and the string come together for clamping. There is also a need for an apparatus which will prevent the closing of the slips when the control line is near the tubular string.

SUMMARY OF THE INVENTION

In one embodiment, an apparatus for positioning a control line includes a guide boom pivotable around a location adjacent the string and with a guide member at an end thereof to guide the control line. The apparatus further includes a clamp boom that is independently pivotable and includes a clamp housing at an end thereof for carrying and locating a clamp to clamp the control line against the tubular string. The guide boom structure and the clamp boom structure each have a center line which is substantially aligned with the center line of the tubing string permitting the control line to be aligned adjacent the tubular string prior to clamping.

In another embodiment, a method of positioning a control line includes locating a guide boom at a location adjacent the tubular string, wherein the guide boom includes a guide member at an end thereof to guide the line. The method further includes locating a clamp boom at a location adjacent the tubular string, wherein the clamp boom includes a removable clamp. Additionally, the method includes clamping the line to the tubular string by utilizing the clamp and relocating the booms to a location away from the tubular string while leaving the line clamped to the tubular string.

In another embodiment, a protection tool is provided to protect a control line in a safe area while one or more slips of a spider are being closed.

In yet another embodiment, a safety interlock system is provided to prevent the closing of the slips before the control line is pulled away from the tubular string.

In yet another embodiment, a protection tool for a control line in a tubular gripping member comprises a barrier adapted to be disposed adjacent the control line, whereby the control line is prevented from engagement with a gripping element of the tubular gripping member.

In yet another embodiment, a tubular gripping member for use with a control line comprises a slip; and a sensing mechanism adapted to engage the control line, whereby engagement with the control line indicates that the control line is retracted from a path of travel of the slip.

In yet another embodiment, a safety interlock system includes a safety interlock trigger adapted to be actuated by a protection tool. The safety interlock trigger is adapted to detect the physical presence of the protection tool, and thereafter send a signal to the interlock system to allow closing of the slips.

In yet another embodiment, a protection tool for a control line in a tubular gripping member comprises a protection tool adapted to be disposed adjacent the control line, whereby the control line is prevented from engagement with a gripping element of the tubular gripping member. In another embodiment, the protection tool is adapted to retain the control line in a safe area within the tubular gripping member.

In yet another embodiment, a safety interlock system for controlling operation of a gripping element to prevent damage to a control line comprises an interlock controller adapted to prevent or allow movement of the gripping element, and an interlock sensor adapted to determine a position of the control line. The interlock controller enables or disables movement of the gripping element in response to a signal sent by the interlock sensor indicating the position of the control line. In one embodiment, the interlock sensor determines the position of the control line by detecting the presence of a protection tool for the control line. In another embodiment, the interlock sensor physically engages the protection tool. In yet another embodiment, the interlock sensor determines the position of the control line by determining a position of a control line positioning device.

In yet another embodiment, a method of running a control line along with a tubular string comprises providing a protection tool; moving the control line to a position away from a tubular string; disposing the protection tool adjacent to the control line; and engaging a gripping element with the tubular string, whereby the control line is prevented from engagement with the gripping element. In one embodiment, the method further comprises providing an interlock system for preventing or allowing movement of the gripping element. In another embodiment, the interlock system is adapted to detect a position of the control line. In yet another embodiment, the interlock system is adapted to detect the presence of the protection tool. In yet another embodiment, the interlock system allows or prevents movement of the gripping elements in response to the presence or absence of the protection tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments and are therefore not to be considered limiting of scope, for the invention may admit to other equally effective embodiments.

DETAILED DESCRIPTION

Figure 1:
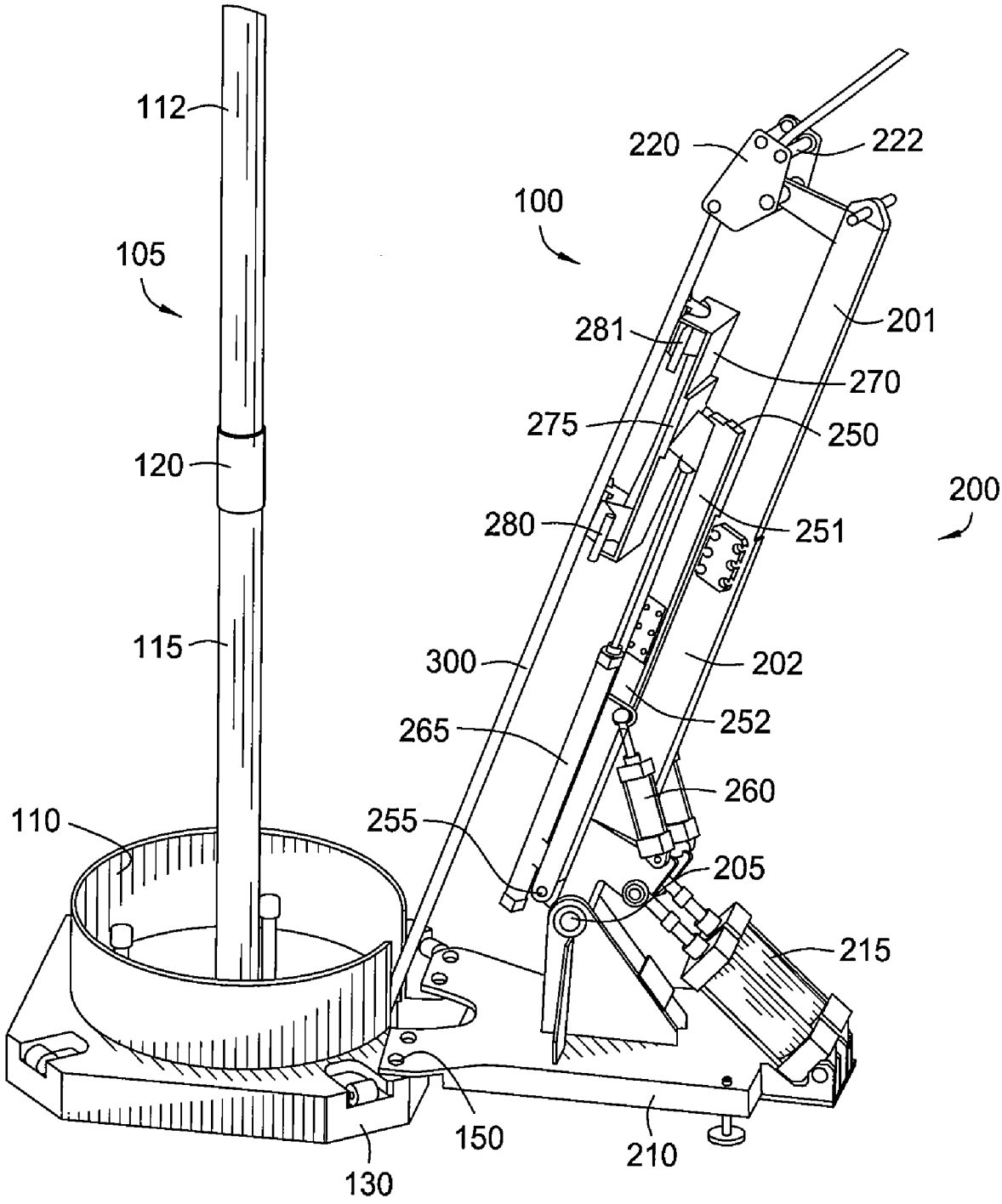
FIG. 1 illustrates one embodiment of an assembly used to facilitate the clamping of a control line to a tubular string.

FIG. 1 illustrates one embodiment of an assembly 100 used to facilitate the clamping of a control line 300 to a tubular string 105. The assembly 100 is movable between a staging position and a clamping position. As shown, the assembly 100 is located adjacent the surface of a well 110. Extending from the well 110 is the tubular string 105 comprising a first 112 and a second 115 tubulars connected by a coupling 120. Not visible in FIG. 1 is a spider which consists of slips that retain the weight of the tubular string 105 at the surface of the well 110. Also not shown is an elevator or a spider which would typically be located above the rig floor or work surface to carry the weight of the tubular 112 while the tubular 112 is aligned and threadedly connected to the upper most tubular 115 to increase the length of tubular string 105. The general use of spiders and elevators to assemble strings of tubulars is well known and is shown in U.S. Publication No. US-2002/0170720-A1, which is incorporated herein by reference in its entirety. Exemplary control lines (also known as umbilical cords or parasitic strings) may provide electrical, hydraulic, pneumatic, or fiber optic means of signals transmission, control, power, and combinations thereof. Suitable control lines include electrical cable, hydraulic line, small diameter pipe, fiber optics, and coiled tubing.

The assembly 100 includes a guide boom 200 or arm, which in one embodiment is a telescopic member made up of an upper 201 and a lower 202 boom. Guide boom 200 is mounted on a base 210 or mounting assembly at a pivot point 205. Typically, the guide boom 200 extends at an angle relative to the base 210, such as an angle greater than 30 degrees. A pair of fluid cylinders 215 or motive members permits the guide boom 200 to move in an arcuate pattern around the pivot point 205. Visible in FIG. 1 is a spatial relationship between the base 210 and a platform table 130. Using a fixing means, such as pins 150, the base 210 is fixed relative to the table 130, thereby permitting the guide boom 200 to be fixed relative to the tubular string 105 extending from the well 110, and preferably, the guide boom 200 is fixed relatively proximate the tubular string 105 or well center. In this manner, the vertical center line of the guide boom 200 is substantially aligned with the vertical center line of the tubular string 105. Also, as the guide boom 200 pivots around the pivot point 205 to approach the tubular string 105 (see FIG. 2), the path of the boom 200 and the tubular string 105 will reliably intersect. This helps ensure that the control line 300 is close enough to the string 105 for a clamp 275 to be manually closed around the string 105 as described below. In another embodiment, the guide boom 200 may be adapted to move laterally to or away from the tubular string instead of an arcuate motion.

As shown in FIG. 1, a guide 220 or a control line holding assembly is disposed at an upper end of guide boom 200. The guide boom 220 has a pair of rollers 222 mounted therein in a manner which permits the control line 300 to extend through the rollers 222. It must be noted that any number of rollers or smooth surface devices may be used to facilitate movement of the control line 300.

Generally, the control line 300 is supplied from a reel (not shown) which is located proximate the guide boom 200 but far enough from the center of the well 110 to avoid interfering with the spider, elevator, or draw works associated with the tubular string 105. In another embodiment, the reel may be positioned at any convenient location to supply the control line 300. The control line 300 can provide power or signals or both in any number of ways to a component or other device disposed in the well 110. Reels used to supply control lines are well known in the art and are typically pre-tensioned, whereby the control line will move off the reel as it is urged away from the reel while permitting the reel to keep some tension on the line and avoiding unnecessary slack.

Also visible in FIG. 1 is a clamp boom 250 or arm, which in one embodiment is a telescopic member made up of an upper 251 and a lower 252 boom. The clamp boom 250 is mounted substantially parallel to the guide boom 200. The clamp boom 250 includes a pivot point 255 adjacent the pivot point 205 of guide boom 200. The clamp boom 250 is moved by one or more fluid cylinders. For instance, a pair of fluid cylinders 260 moves the clamp boom 250 around the pivot point 255 away from the guide boom 200. Another fluid cylinder 265 causes the clamp boom 250 to lengthen or shorten in a telescopic fashion. Since the clamp boom 250 is arranged similarly to the guide boom 200, the clamp boom 250 also shares a center line with the tubular string 105. As defined herein, a fluid cylinder may be hydraulic or pneumatic. Alternatively, the booms 200, 250 may be moved by another form of a motive member such as a linear actuator, an electric or fluid operated motor or any other suitable means known in the art. In another embodiment, the booms 200, 250 may be manually moved.

Figure 3:
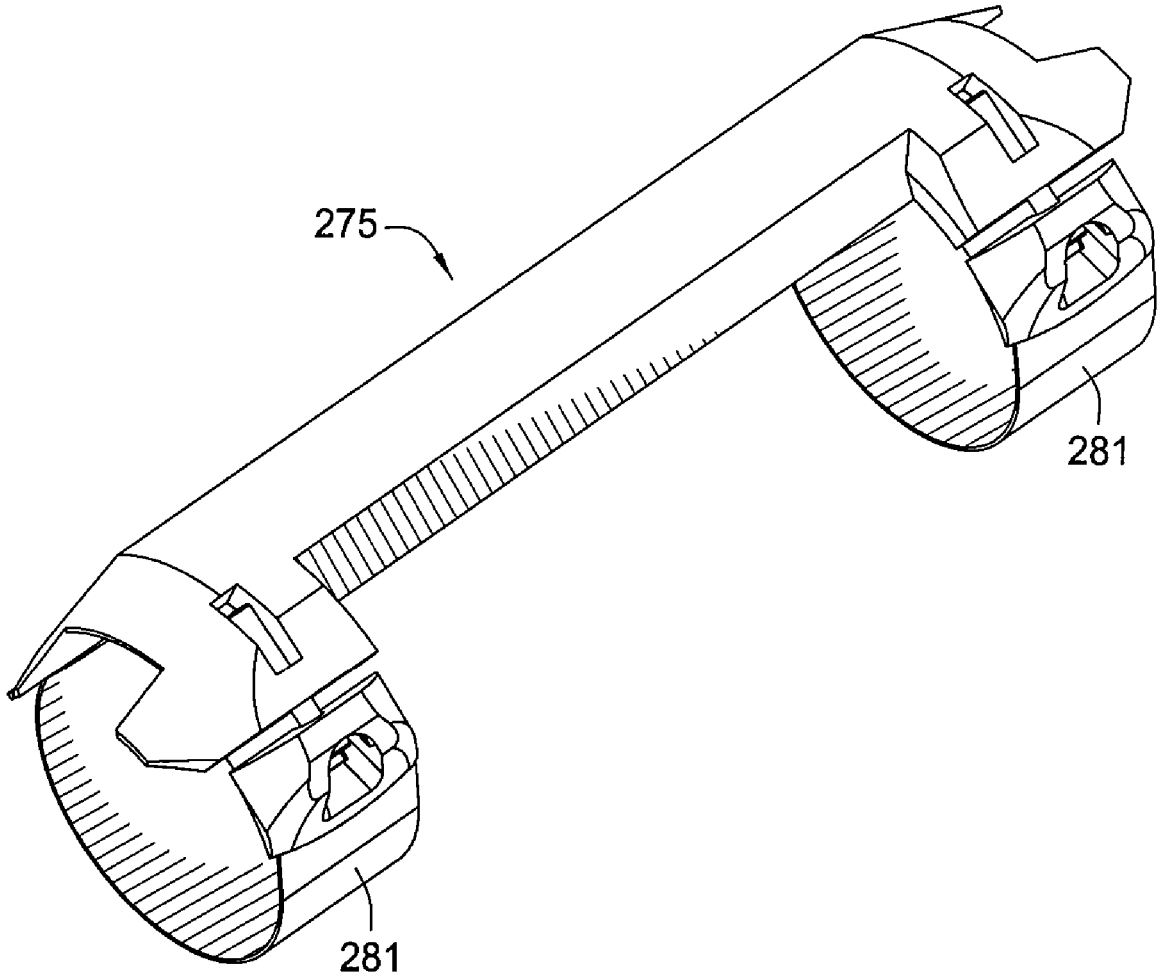
FIG. 3 is a detailed view of the clamp.

As shown in FIG. 1, a clamp holding assembly comprising a clamp housing 270 and a removable clamp 275 is disposed at an end of the clamp boom 250. The removable clamp 275 includes a first clamp member 280 and a second clamp member 281 designed to reach substantially around and embrace a tubular member, clamping, or securing a control line together with the tubular member. More specifically, the clamp 275 is designed to straddle the coupling 120 between two tubulars 112, 115 in the tubular string 105. For example, in the embodiment of FIG. 1, the clamp 275 is designed such that one clamp member 281 will close around the lower end of tubular 112 and another clamp member 280 will close around an upper end of tubular 115, thereby straddling the coupling 120. A frame portion between the clamp members 280, 281 covers the coupling 120. The result is a clamping arrangement securing the control line 300 to the tubular string 105 and providing protection to the control line 300 in the area of coupling 120. A more detailed view of the clamp 275 is shown in FIG. 3. In the preferred embodiment, the clamp 275 is temporarily held in the clamp housing 270 and then is releasable therefrom.

Figure 2:
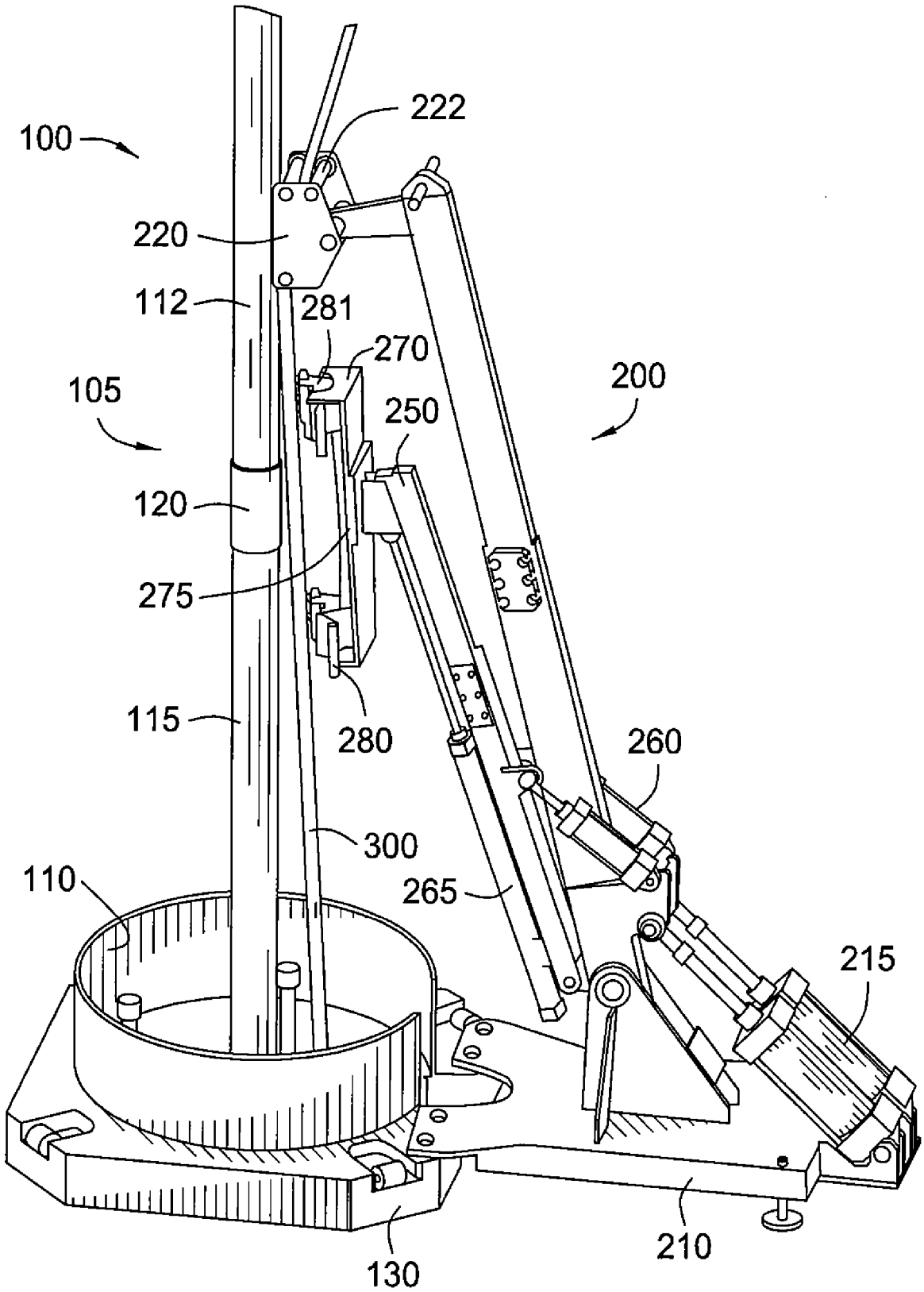
FIG. 2 illustrates the assembly of FIG. 1 in a position whereby the control line has been brought to a location adjacent the tubular string for the installation of a clamp.

FIG. 2 illustrates the assembly 100 in a position adjacent the tubular string 105 with the clamp 275 ready to engage the tubular string 105. Comparing the position of the assembly 100 in FIG. 2 with its position in FIG. 1, the guide boom 200 and the clamp boom 250 have both been moved in an arcuate motion around pivot point 205 by the action of fluid cylinders 215. Additionally, the cylinders 260 have urged the clamp boom 250 to pivot around the pivot point 255. The fluid cylinder 265 remains substantially in the same position as in FIG. 1, but as is apparent in FIG. 2, could be adjusted to ensure that coupling 120 is successfully straddled by the clamp 275 and that clamp members 280, 281 may be secured around tubulars 112 and 115, respectively. In FIG. 2, the guide 220 is in close contact with or touching tubular 112 to ensure that the control line 300 is running parallel and adjacent the tubular string 105 as the clamp boom 250 sets up the clamp 275 for installation. The quantity of control line 300 necessary to assume the position of FIG. 2 is removed from the pretensioned reel as previously described.

Still referring to FIG. 2, the clamp boom 250 is typically positioned close to the tubular string 105 by manipulating fluid cylinders 260 until the clamp members 280, 281 of the clamp 275 can be manually closed by an operator around tubulars 112 and 115. Thereafter, the clamp 275 is removed from the housing 270 either manually or by automated means and the assembly 100 can be retracted back to the position of FIG. 1. It should be noted that any number of clamps can be installed on the tubular string 105 using the assembly 100, and the clamps do not necessarily have to straddle a coupling.

In operation, the tubular string 105 is made at the surface of the well with subsequent pieces of tubular being connected together utilizing a coupling. Once a "joint" or connection between two tubulars is made, the tubular string 105 is ready for control line 300 installation before the tubular string 105 is lowered into the wellbore to a point where a subsequent joint can be assembled. To install the control line 300, the guide boom 200 and the clamp boom 250 are moved in an arcuate motion to bring the control line 300 into close contact and alignment with the tubular string 105. Thereafter, the cylinders 260 operating the clamp boom 250 are manipulated to ensure that the clamp 275 is close enough to the tubular string 105 to permit its closure by an operator and/or to ensure that the clamp members 280, 281 of the clamp 275 straddle the coupling 120 between the tubulars. In another embodiment, the guide boom 200 and/or the clamp boom 250 may be provided with one or more sensors to determine the position of the coupling 120 relative to the clamp members 280, 281. In this respect, the clamp members 280, 281 may be adjusted to ensure that they straddle the coupling 120. In another embodiment, the draw works may be adapted to position the elevator at a predetermined position such that the clamp member 280, 281 will properly engage the coupling 120. In another embodiment still, the proper position of the elevator may be adjusted during operation and thereafter memorized. In this respect, the memorized position may be "recalled" during operation to facilitate positioning of the elevator. It must be noted that other top drive components such as a torque head or spear may be used as reference points for determining the proper position of the coupling 120 such that their respective positions may be memorized or recalled to position the coupling 120.

After the assembly 100 is positioned to associate the clamp 275 with tubular string 105, an operator closes the clamp members 280, 281 around the tubulars 112, 115, thereby clamping the control line 300 to the tubulars 112, 115 in such a way that it is held fast and also protected, especially in the area of the coupling 120. Thereafter, the removable clamp 275 is released from the clamp housing 270. The assembly 100 including the guide boom 200 and the clamp boom 250 is retracted along the same path to assume a retracted position like the one shown in FIG. 1. The tubular string 105 may now be lowered into the wellbore along with the control line 300 and another clamp 275 may be loaded into the clamp housing 270.

In one embodiment, the guide boom and the clamp boom fluid cylinders are equipped with one or more position sensors which are connected to a safety interlock system such that the spider cannot be opened unless the guide boom 200 and the clamp boom 250 are in the retracted position. Alternatively, such an interlock system may sense the proximity of the guide boom and clamp boom to the well center, for example, by either monitoring the angular displacement of the booms with respect to the pivot points or using a proximity sensor mounted in the control line holding assembly or the clamp holding assembly to measure actual proximity of the booms to the tubular string. In one embodiment, regardless of the sensing mechanism used, the sensor is in communication with the spider and/or elevator (or other tubular handling device) control system. The control system may be configured to minimize the opportunity for undesirable events and potential mishaps to occur during the tubular and control line running operation. Examples of such events/mishaps include, but are not limited to: a condition in which the spider and elevator are both released from the tubular string, resulting in the tubular string being dropped into the wellbore; interference between the gripping elements of either the spider or elevator with the control line; interference between either the spider or elevator and the control line positioning apparatus; interference between either the spider or elevator and the control line clamp positioning apparatus; interference between either the spider or elevator and a tubular make-up tong; interference between a tubular make-up tong and either the control line positioning apparatus and/or the control line clamp positioning apparatus, and/or the control line itself. Hence the safety interlock and control system provide for a smooth running operation in which movements of all equipment (spider, elevator, tongs, control line positioning arm, control line clamp positioning arm, etc.) are appropriately coordinated.

Such an interlock system may also include the rig draw works controls. The aforementioned boom position sensing mechanisms may be arranged to send signals (e.g., fluidic, electric, optic, sonic, or electromagnetic) to the draw works control system, thereby locking the draw works (for example, by locking the draw works brake mechanism in an activated position) when either the control line or clamp booms are in an operative position. In this respect, the tubular string may be prevented from axial movement. However, it must noted that the boom position sensing mechanisms may be adapted to allow for some axial movement of the draw works such that the tubular string's axial position may be adjusted to ensure the clamp members 280, 281 straddle the coupling 120. Some specific mechanisms that may be used to interlock various tubular handling components and rig devices are described in U.S. Publication No. US-2004/00069500 and U.S. Pat. No. 6,742,596 which are incorporated herein in their entirety by reference.

Figure 4:
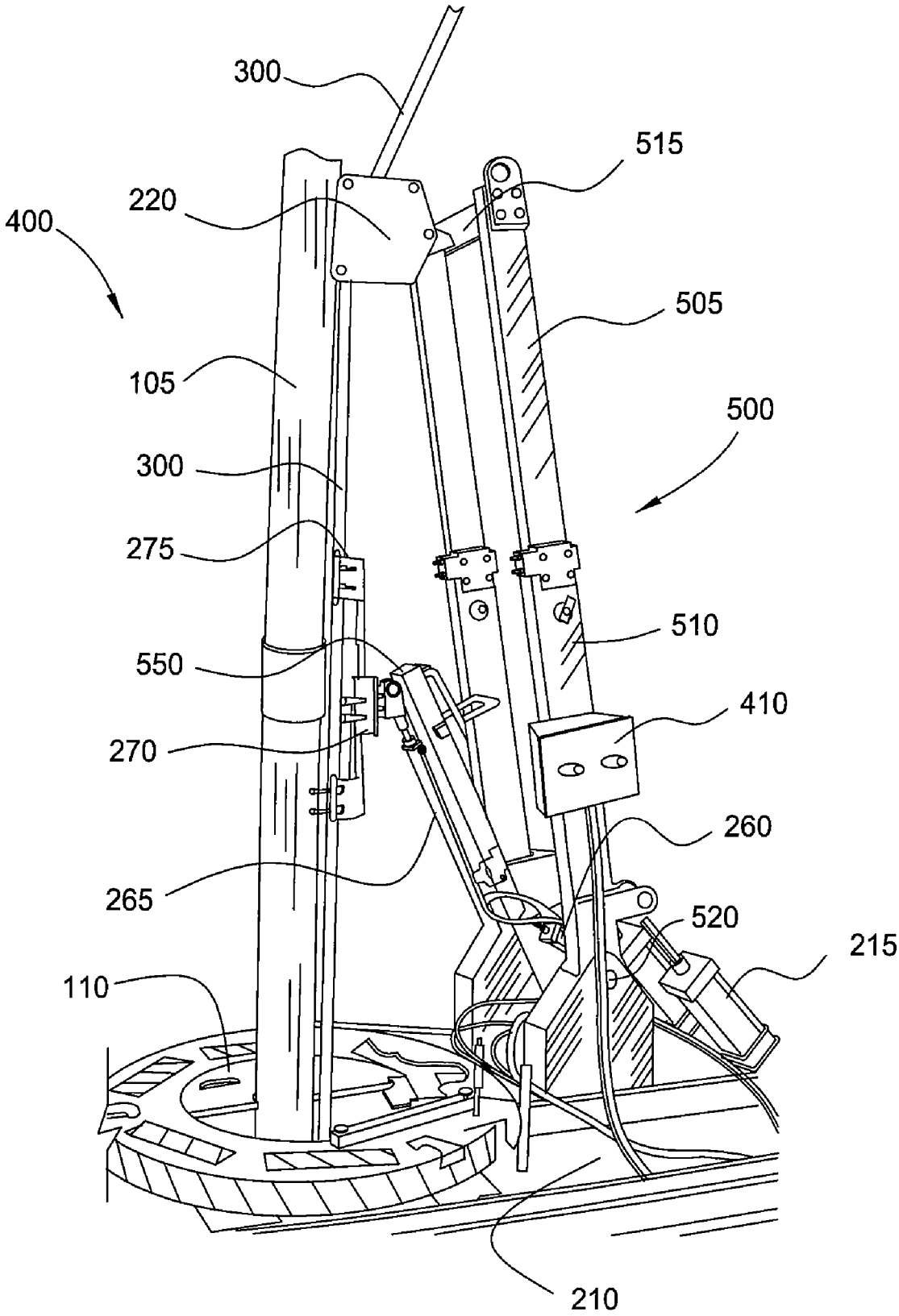
FIG. 4 illustrates another embodiment of an assembly used to facilitate the clamping of the control line to tubular string.

FIG. 4 illustrates another embodiment of an assembly 500 used to facilitate the clamping of the control line 300 to the tubular string 115. For convenience, the components in the assembly 400 that are similar to the components in the assembly 100 will be labeled with the same number indicator.

As illustrated, the assembly 400 includes a guide boom 500. The guide boom 500 operates in a similar manner as the guide boom 200 of assembly 100. However, as shown in FIG. 4, the guide boom 500 has a first boom 505 and a second boom 510 that are connected at an upper end thereof by a member 515. The member 515 supports the guide 220 at an end of the guide boom 500. Additionally, the guide boom 500 is mounted on the base 210 at pivot points 520. Similar to assembly 100, the pair of fluid cylinders 215 permits the guide boom 500 to move in an arcuate pattern around pivot points 520. In one embodiment, each boom 505, 510 may include an upper and a lower boom which are telescopically related to each other to allow the guide boom 500 to be extended and retracted in a telescopic manner.

Also visible in FIG. 4 is a clamp boom 550, which in one embodiment is a telescopic member made from an upper and a lower boom. The clamp boom 550 extends at an angle relative to the base 210. In one embodiment, the clamp boom 550 is movable at least 100 degrees, or the clamp boom 550 may be adapted to move in any suitable angle. The clamp boom 550 is mounted between the booms 505, 510 of the guide boom 500. The clamp boom 550 having a pivot point (not shown) adjacent the pivot points 520 of guide boom 500. Typically, the clamp boom 550 is manipulated by a plurality of fluid cylinders. For instance, a pair of fluid cylinders (not shown) causes the clamp boom 550 to move around the pivot point. Another fluid cylinder 265 causes the clamp boom 550 to lengthen or shorten in a telescopic fashion. The clamp boom 550 is positioned adjacent the tubular string 105 so that the clamp boom 550 shares a center line with the tubular string 105. In a similar manner as the clamp boom 250 in assembly 100, the clamp boom 550 includes the clamp assembly comprising the clamp housing 270 and the removable clamp 270 disposed at an end thereof.

Similar to the operation of assembly 100, the guide boom 500 and the clamp boom 550 of the assembly 400 are moved in an arcuate motion bringing the control line 300 into close contact and alignment with the tubular string 105. Thereafter, the cylinders 260 operating the clamp boom 550 are manipulated to ensure that the clamp 275 is close enough to the tubular string 105 to permit its closure by an operator.

After the assembly 400 is positioned adjacent the tubular string 105, the operator closes the clamp 275 around the tubular string 105 and thereby clamps the control line 300 to the tubular string 105 in such a way that it is held fast and also protected, especially if the clamp 275 straddles a coupling in the tubular string 105. Thereafter, the clamp boom 550 may be moved away from the control line 300 through a space defined by the booms 505, 510 of the guide boom 500 to a position that is a safe distance away from the tubular string 105 so that another clamp 275 can be loaded into the clamp housing 270.

The manipulation of either assembly 100 or assembly 400 may be done manually through a control panel 410 (shown on FIG. 4), a remote control console or by any other means know in the art. The general use of a remote control console is shown in U.S. Publication No. US-2004/0035587-A1, which has been incorporated herein by reference.

In one embodiment a remote console (not shown) may be provided with a user interface such as a joystick which may be spring biased to a central (neutral) position. When the operator displaces the joystick, a valve assembly (not shown) controls the flow of fluid to the appropriate fluid cylinder. As soon as the joystick is released, the appropriate boom stops in the position which it has obtained.

The assembly 100, 400 typically includes sensing devices for sensing the position of the boom. In particular, a linear transducer is incorporated in the various fluid cylinders that manipulate the booms. The linear transducers provide a signal indicative of the extension of the fluid cylinders which is transmitted to the operator's console.

In operation, the booms (remotely controllable heads) are moved in an arcuate motion bringing the control line into close contact and alignment with the tubular string. Thereafter, the cylinders operating the clamp boom are further manipulated to ensure that the clamp is close enough to the tubular string to permit the closure of the clamp. When the assembly is positioned adjacent the tubular string, the operator presses a button marked "memorize" on the console.

The clamp is then closed around the tubular string to secure the control line to the tubular string. Thereafter, the clamp boom and/or the guide boom are retracted along the same path to assume a retracted position. The tubular string can now be lowered into the wellbore along with the control line and another clamp can be loaded into the clamp housing.

After another clamp is loaded in the clamp housing, the operator can simply press a button on the console marked "recall" and the clamp boom and/or guide boom immediately moves to their memorized position. This is accomplished by a control system (not shown) which manipulates the fluid cylinders until the signals from their respective linear transducers equal the signals memorized. The operator then checks the alignment of the clamp in relation to the tubular string. If they are correctly aligned, the clamp is closed around the tubular string. If they are not correctly aligned, the operator can make the necessary correction by moving the joystick on his console. When the booms are correctly aligned the operator can, if he chooses, update the memorized position. However, this step may be omitted if the operator believes that the deviation is due to the tubular not being straight.

While the foregoing embodiments contemplate fluid control with a manual user interface (i.e. joy stick) it will be appreciated that the control mechanism and user interface may vary without departing from relevant aspects of the inventions herein. Control may equally be facilitated by use of linear or rotary electric motors. The user interface may be a computer and may in fact include a computer program having an automation algorithm. Such a program may automatically set the initial boom location parameters using boom position sensor data as previously discussed herein. The algorithm may further calculate boom operational and staging position requirements based on sensor data from the other tubular handling equipment and thereby such a computer could control the safety interlocking functions of the tubular handling equipment and the properly synchronized operation of such equipment including the control line and clamp booms.

The aforementioned safety interlock and position memory features can be integrated such that the booms may automatically return to their previously set position unless a signal from the tubular handling equipment (e.g. spider/elevator, draw works) indicates that a reference piece of handling equipment is not properly engaged with the tubular.

While the assembly is shown being used with a rig having a spider in the rig floor, it is equally useful in situations when the spider is elevated above the rig floor for permit greater access to the tubular string being inserted into the well. In those instances, the assembly could be mounted on any surface adjacent to the tubular string. The general use of such an elevated spider is shown in U.S. Pat. No. 6,131,664, which is incorporated herein by reference. As shown in FIG. 1 of the '664 patent, the spider is located on a floor above the rig floor that is supported by vertical support members such as walls, legs, or other suitable support members. In this arrangement, the apparatus may be mounted on the underside of the floor supporting the spider or on one of the support members.

Various modifications to the embodiments described are envisaged. For example, the positioning of the clamp boom to a predetermined location for loading a clamp into the clamp housing could be highly automated with minimal visual verification. Additionally, as described herein, the position of the booms is memorized electronically, however, the position of the booms could also be memorized mechanically or optically.

Figure 5C:
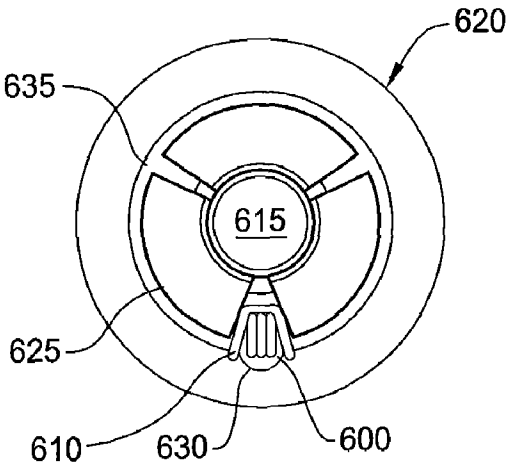
FIGS. 5A-C illustrate a protection tool used to prevent damage to a control line.
Figure 5B:
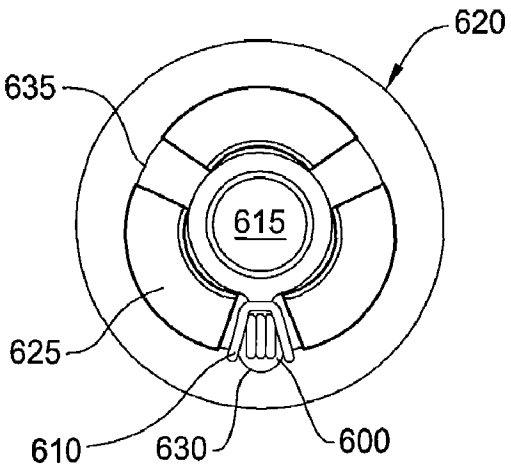
Figure 5A:
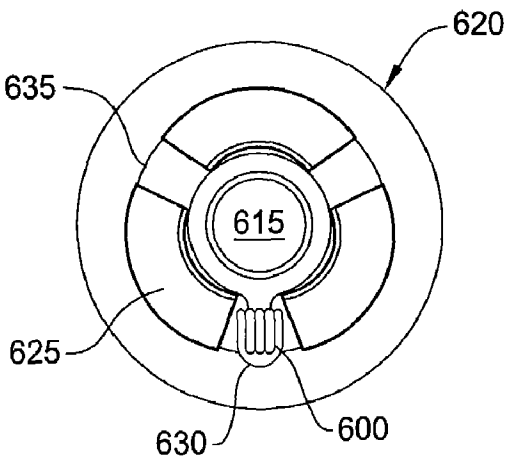

In another embodiment, apparatus and methods are provided to prevent accidental closure of the slips around the control line. FIGS. 5A-C show a protection tool 610 in use with a spider 620 to maintain the control line 600 away from the tubular string 615. Referring now to FIG. 5A, the spider 620 is shown with the slips 625 in the open position. The control line 600 has been pulled away from the tubular string 615 and positioned in a safe area 630 such as a groove in the body 635 of the spider 600. Before the slips 625 are closed, the protection tool 610 is disposed around the control line 600 as shown in FIG. 5B. Exemplary protection tools include a barrier such as a plate, a sleeve, a chute, a line, or any tool capable of retaining the control line in the safe area while closing the slips. FIG. 5C shows the slips 625 closed around the tubular string 615. It can be seen in FIG. 5C that the protection tool 610 prevents the control line 600 from being damaged by the slips 625. It is contemplated that the control line may be moved manually by an operator, the control line positioning device described herein, or any suitable control line positioning device.

Figures 6A, 6B, 6C:
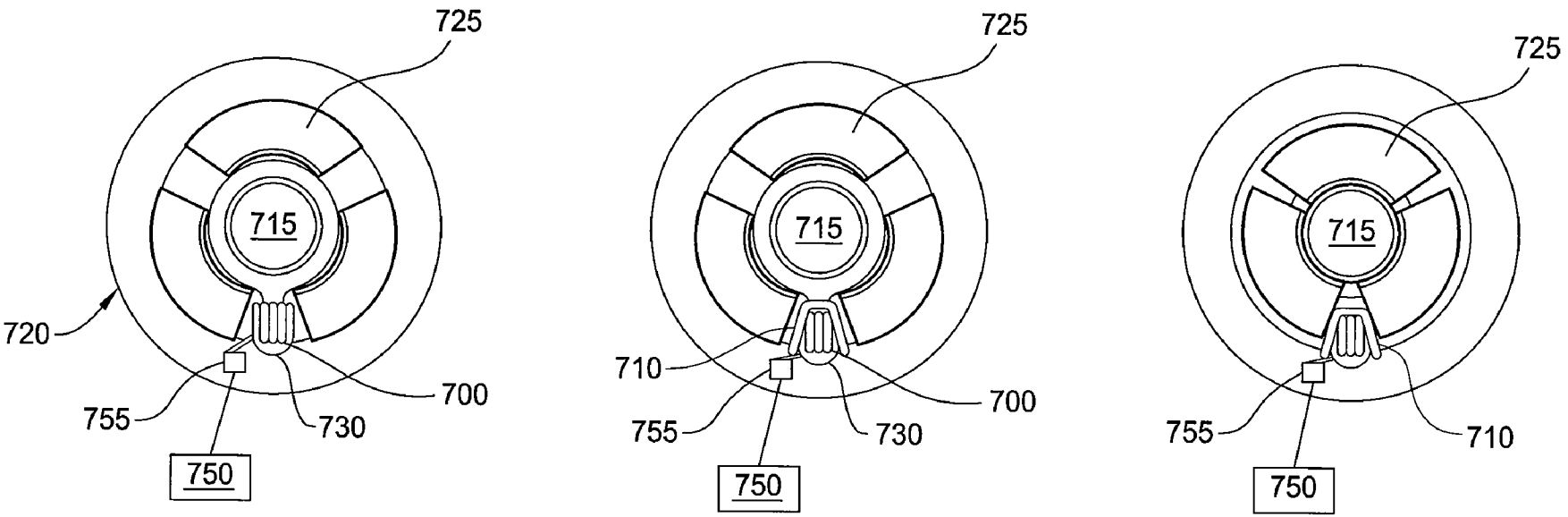
FIG. 6A-C illustrate a safety interlock system used to prevent damage to a control line.

In another embodiment, a safety interlock system may be used to prevent control line damage, as shown in FIGS. 6A-C. Referring to FIG. 6A, the spider 720 is shown with the slips 725 in the open position and is provided with an interlock system having a safety interlock trigger 755 and an interlock controller 750. The safety interlock trigger 755 is adapted to send one or more signals to the interlock controller 750 to control the movement of the slips 725. As shown, the safety interlock trigger 750 is initially in the unactuated position and is adapted to be actuated by the protection tool 710. The interlock controller 750 prevents the slips 725 from closing until the safety interlock trigger 755 is actuated by the protection tool 710. In one embodiment, the safety interlock trigger 755 comprises an interlock valve which can be operated by the presence of the protection tool 710. In another embodiment, the safety interlock trigger 755 comprises a sensor when can detect the presence of the protection tool 710. The sensor may be selected from an electrical sensor, optical sensor, and any suitable sensor for detecting the presence of the protection tool. It is contemplated that the safety interlock trigger may comprise any suitable device capable of determining that the control line is protected by the protection tool 710.

In FIG. 6B, the protection tool 710 has been installed to retain the control lines 700 in the safe area 730. As shown, the protection tool 710 physically engages the interlock trigger 755, thereby causing the interlock trigger 755 to send a signal to the interlock controller 750 indicating that the control line 700 is protected. In turn, the interlock controller 750 may allow the slips 725 to safely close around the tubular string 715. Because the slips 725 cannot close until the protection tool 710 is installed, the slips 725 are prevented from accidentally closing on the control line 700. FIG. 6C shows the slips 725 in the closed position and the control line 700 cleared from potential damage by the slips 725. When the slips 725 are open again, the protection tool 710 is removed to allow the pusher arm (or any control line manipulating apparatus) to move the control line 700 toward the tubular string 725 for clamping therewith. It is contemplated that the protection tool and/or the safety interlock may be used in conjunction with the pusher device to facilitate the installation of the control line and to prevent damage to the control line. It is further contemplated that the protection tool and/or safety interlock may be used with manual installation of the control line. It is further contemplated that the protection tool and/or the safety interlock are usable with any tubular gripping device having one or more slips and is adapted for running tubulars.

In another embodiment, the spider is provided with sensing mechanism, such as a spring loaded roller assembly or sleeve, that is adapted to engage the control line in the retracted position. When the control line is retracted in the safe area, the control line is pushed against the sensing mechanism (roller assembly). In turn, the sensing mechanism (roller assembly) activates an interlock valve adapted to only allow closing of the slips when the sensing mechanism (roller) is fully pushed back or otherwise engaged by the control line.

In another embodiment, the spider may be provided with a manually activated interlock switch. The interlock switch must be manually activated by a control line operator before the slips can be closed.

In another embodiment, a retaining member is used to secure the control line in a safe area inside the spider when it is desired to close the slips. The retaining member activates the interlock valve or sensor when it is safe to close the slips, thereby preventing accidental closing of the slips when the control lines are exposed for potential damage.

While the foregoing is directed to embodiments of the present invention, other and further embodiments of the invention may be devised without departing from the basic scope thereof, and the scope thereof is determined by the claims that follow.

We claim:

1. A method of running a control line along with a tubular string using a gripping apparatus having a gripping element, comprising:

providing an interlock system for preventing or allowing movement of the gripping element and a protection tool;

moving the control line to a position away from a tubular string;

inserting the protection tool adjacent to the control line;

detecting the presence of the protection tool;

operating the interlock system to allow the gripping element to move toward the tubular string in response to the presence of the protection tool; and engaging the gripping element with the tubular string, whereby the control line is prevented from engagement with the gripping element.

2. The method of claim 1, wherein the interlock system is adapted to detect a position of the control line.

3. The method of claim 2, wherein the interlock system prevents or allows movement of the gripping elements in response to the position of the control line.

4. The method of claim 1, wherein the interlock system prevents or allows movement of the gripping elements in response to the presence of the protection tool.

5. The method of claim 1, further comprising opening the gripping element.

6. The method of claim 5, further comprising removing the protection tool.

7. The method of claim 6, further comprising detecting removal of the protection tool.

8. The method of claim 6, further comprising moving the control line toward the tubular string.

9. The method of claim 8, further comprising clamping the control line to the tubular string.

10. The method of claim 8, wherein the control line is moved using a control line positioning device.

11. The method of claim 10, further comprising clamping the control line to the tubular string.

12. The method of claim 11, further comprising moving the control line positioning device away from the tubular string.

13. The method of claim 12, further comprising lowering the tubular string.

14. A safety interlock system for controlling operation of a gripping element to prevent damage to a control line, comprising:

an interlock controller adapted to allow or prevent movement of the gripping element; and an interlock trigger adapted to indicate a position of the control line, wherein the interlock controller allows or prevents movement of the gripping element in response to a signal sent by the interlock trigger indicating the position of the control line.

15. The safety interlock system of claim 14, wherein the gripping element comprises a slip.

16. The safety interlock system of claim 14, wherein the position of the control line is determined by detecting the presence of a protection tool for the control line.

17. The safety interlock system of claim 16, wherein the interlock trigger physically engages the protection tool.

18. The safety interlock system of claim 14, wherein the position of the control line is determined by determining a position of a control line positioning device.

19. A method of running a control line along with a tubular string through a gripping apparatus having a gripping element, comprising:

providing the gripping apparatus with an interlock system for preventing or allowing movement of the gripping element in response to a position of the control line, wherein the interlock system is configured to prevent movement of the gripping element until the control line is away from the tubular string;

moving the control line away from a tubular string;

determining the control line is positioned away from the tubular string, and thereafter, allowing the gripping element to move into engagement with the tubular string; and moving the gripping element into engagement with the tubular string.

20. The method of claim 19, wherein the position away from the tubular string is a position in the gripping apparatus where movement of the gripping element will not contact the control line.

21. The method of claim 19, further comprising providing a barrier to prevent contact of the control line with the gripping element.

22. The method of claim 21, wherein determining the control line is away from the tubular string comprises detecting presence of the barrier.

23. The method of claim 19, wherein allowing the gripping element to move comprises manually activating an interlock switch.

24. A method of running a control line along with a tubular string through a gripping apparatus, comprising:

moving the control line away from a tubular string;

positioning a retaining member between the control line and the tubular string;

sending a signal to an interlock controller indicating the retaining member is positioned between the control line and the tubular string;

allowing a gripping element to move toward the tubular string in response to the signal; and moving the gripping element into engagement with the tubular string.

25. The method of claim 24, wherein the retaining member is positioned between two gripping elements.

26. The method of claim 24, further comprising moving the gripping element away from the tubular string.

27. The method of claim 26, further comprising moving the control line toward the tubular string and preventing the gripping element from closing.

28. The method of claim 24, wherein the control line is positioned in a safe area of the gripping apparatus where movement of the gripping element will not contact the control line.

29. The method of claim 28, wherein the safe area comprises a recess in the body of the gripping apparatus.

30. The method of claim 29, wherein the gripping apparatus comprises a spider.

31. The method of claim 24, wherein moving the control line comprises using a control line manipulating arm to move the control line to or away from the tubular string.

32. The method of claim 31, further comprising preventing or allowing movement of the griping element in response to a position of the control line manipulating arm.

33. The method of claim 24, wherein the retaining member comprises a protection tool.

34. A tubular gripping assembly for use with a control line, comprising:

a slip;

a sensing mechanism for determining a position of the control line in the tubular gripping member; and an interlock system for preventing or allowing movement of the slip in response to an interaction between the sensing mechanism and the control line.

35. The tubular gripping assembly of claim 34, wherein the interaction comprises physical engagement of the control line to the sensing mechanism.

36. The tubular gripping assembly of claim 35, wherein the sensing mechanism comprises a control line detection device.

37. The tubular gripping assembly of claim 35, wherein the sensing mechanism comprises a roller assembly.

38. The tubular gripping assembly of claim 35, wherein the sensing mechanism comprises a sleeve.

39. The tubular gripping assembly of claim 34, wherein the sensing mechanism is interconnected with an interlock valve for allowing or preventing movement of the slip.

* * * * *